US011191993B1

(12) United States Patent
Chen

(10) Patent No.: US 11,191,993 B1
(45) Date of Patent: Dec. 7, 2021

(54) EXERCISE DEVICE WITH ADJUSTABLE BASE

(71) Applicant: FLORIEY INDUSTRIES INTERNATIONAL CO., Taichung (TW)

(72) Inventor: Paul Chen, Taichung (TW)

(73) Assignee: FLORIEY INDUSTRIES INTERNATIONAL CO., Taichung (TW)

( * ) Notice: Subject to any disclaimer, the term of this patent is extended or adjusted under 35 U.S.C. 154(b) by 0 days.

(21) Appl. No.: 16/892,342

(22) Filed: Jun. 4, 2020

(51) Int. Cl.
*A63B 21/072* (2006.01)
*A63B 21/075* (2006.01)
*A63B 71/00* (2006.01)

(52) U.S. Cl.
CPC ..... *A63B 21/0728* (2013.01); *A63B 21/075* (2013.01); *A63B 21/0726* (2013.01); *A63B 71/0036* (2013.01)

(58) Field of Classification Search
CPC ..... A63B 21/072–08; A63B 21/0728; A63B 21/075
See application file for complete search history.

(56) References Cited

U.S. PATENT DOCUMENTS 5,407,413 A 4/1995 Kupferman
5,839,997 A 11/1998 Roth et al.
6,656,093 B2 12/2003 Chen
7,223,214 B2 * 5/2007 Chen ..... A63B 21/075 482/107
7,578,771 B1 * 8/2009 Towley, III ..... A63B 71/0619 482/106
7,731,641 B1 6/2010 Chen
7,811,213 B2 10/2010 Chen
8,007,415 B1 * 8/2011 Lundquist ..... A63B 21/0728 482/107
9,616,273 B2 4/2017 Chen
10,343,010 B2 * 7/2019 Chen ..... A63B 21/075
2002/0183174 A1 * 12/2002 Chen ..... A63B 21/075 482/108
2003/0114276 A1 * 6/2003 Schiff ..... A63B 21/075 482/93
2004/0005969 A1 * 1/2004 Chen ..... A63B 21/063 482/107
2006/0189458 A1 * 8/2006 Walkerdine ..... A63B 71/0036 482/106
2007/0161474 A1 * 7/2007 Lippitt ..... A63B 21/075 482/106

(Continued)

*Primary Examiner* — Nyca T Nguyen
(74) *Attorney, Agent, or Firm* — Browdy and Neimark, PLLC

(57) ABSTRACT

An adjustable exercise device includes a dumbbell having one or more weight members attached to a central handle member, and one or more weight elements attachable to the weight members, and a receptacle includes a housing, two casings engageable to the housing for receiving and engaging with the weight members, and one or more spacers detachably attached to the housing and engaged between the housing and the casings for receiving and engaging with the weight elements. The housing includes two anchoring members, and the casings each include an anchoring element for engaging with the anchoring members and for detachably attaching the casings to the housing.

6 Claims, 6 Drawing Sheets

(56) References Cited

U.S. PATENT DOCUMENTS

| | | | | |
|---|---|---|---|---|
| 2009/0036278 | A1* | 2/2009 | Towley, III | A63B 21/075<br>482/107 |
| 2010/0304938 | A1* | 12/2010 | Olson | A63B 21/0728<br>482/107 |
| 2011/0092345 | A1* | 4/2011 | Svenberg | A63B 21/063<br>482/107 |
| 2012/0021877 | A1* | 1/2012 | Lundquist | A63B 21/075<br>482/107 |
| 2012/0309597 | A1* | 12/2012 | Liu | A63B 21/0726<br>482/107 |
| 2015/0297936 | A1* | 10/2015 | Madden | A63B 21/0728<br>482/107 |
| 2015/0360073 | A1* | 12/2015 | Moran | A63B 21/0726<br>482/107 |
| 2015/0367163 | A1* | 12/2015 | Moran | A63B 71/0036<br>482/108 |
| 2018/0008878 | A1* | 1/2018 | Myre | A63B 21/0728 |
| 2018/0078810 | A1* | 3/2018 | Chen | A63B 21/075 |
| 2018/0078811 | A1* | 3/2018 | Chen | A63B 21/0726 |
| 2018/0353794 | A1* | 12/2018 | Wang | A63B 21/075 |

* cited by examiner

EXERCISE DEVICE WITH ADJUSTABLE BASE

BACKGROUND OF THE INVENTION

1. Field of the Invention

The present invention relates to an adjustable exercise device, and more particularly to an adjustable barbell, kettle bell, or dumbbell having a solid and stable structure or configuration for solidly and stably coupling the weight members of the dumbbell together and for preventing the weight members of the adjustable dumbbell from being disengaged or separated from each other, and having an adjustable supporting base for allowing the supporting base to be suitably adjusted to different sizes or lengths or standards for receiving or engaging with the numbers of the weight members of the exercise device or the adjustable dumbbell.

2. Description of the Prior Art

Various kinds of typical adjustable barbells, kettle bells, or dumbbells have been developed and provided for conducting various exercise operations, for example, U.S. Pat. No. 5,407,413 to Kupferman, U.S. Pat. No. 5,839,997 to Roth et al., U.S. Pat. No. 6,656,093 to Chen, U.S. Pat. No. 7,223,214 to Chen, U.S. Pat. No. 7,731,641 to Chen, U.S. Pat. No. 7,811,213 to Chen, U.S. Pat. No. 9,616,273 to Chen, and U.S. Pat. No. 10,343,010 to Chen disclose several of the typical adjustable dumbbells each including a number of weight rings or weight members that may be selectively or adjustably secured together for adjusting the weight of the dumbbells.

Normally, in the typical adjustable dumbbells, a supporting base of a solid and stable structure or configuration has been provided for receiving or engaging with the weight members or elements.

However, when the numbers of the weight rings or the weight members have been added or increased or attached to the central handle member, the size or the length or the standard of the supporting base may not be adjusted relatively such that the supporting base of the solid and stable structure or configuration may no longer be useful for receiving or engaging with the weight members or elements.

The present invention has arisen to mitigate and/or obviate the afore-described disadvantages of the conventional adjustable barbells, kettle bells, or dumbbells.

SUMMARY OF THE INVENTION

The primary objective of the present invention is to provide an adjustable barbell, kettle bell, or dumbbell including a solid and stable structure or configuration for solidly and stably coupling the weight members of the dumbbell together and for preventing the weight members of the adjustable dumbbell from being disengaged or separated from each other.

The other objective of the present invention is to provide an adjustable barbell, kettle bell, or dumbbell having an adjustable supporting base for allowing the supporting base to be suitably adjusted to different sizes or lengths or standards for receiving or engaging with the numbers of the weight members of the exercise device or the adjustable dumbbell.

In accordance with one aspect of the invention, there is provided an adjustable exercise device comprising a dumbbell including a handle member, a first weight member and a second weight member attached to the handle member, and a first weight element and a second weight element attachable to the first and the second weight members respectively, and a receptacle including a housing, a first casing and a second casing engageable to the housing for receiving and engaging with the first and the second weight members respectively.

The housing includes an anchoring member formed in each of two outer side portions, and the first and the second casings each include an anchoring element for engaging with the anchoring members of the housing and for detachably attaching the first and the second casings to the housing.

The dumbbell includes two plates attached to the handle member, and the first and the second weight members are attachable to the plates respectively, and the housing includes two depressions formed in the housing for receiving and engaging with the plates respectively.

The first and the second casings each include a recess for receiving and engaging with either of the first and the second weight members or of the first and the second weight elements.

One or more first spacers and one or more second spacers may further be provided and detachably attached to the housing and engaged between the housing and the first and the second casings respectively for receiving and engaging with the first and the second weight elements.

The first spacer and the second spacer each include a second anchoring member for engaging with the anchoring element of the first and the second casings, and a second anchoring element for engaging with the anchoring members of the housing and for detachably attaching the first and the second casings and the first spacer and the second spacer and the housing together.

The first spacer and the second spacer each include a space for receiving and engaging with either of the first and the second weight members or of the first and the second weight elements.

One or more anchors and/or one or more fastener may further be provided for detachably securing the first and the second casings and the first spacer and the second spacer and the housing together.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
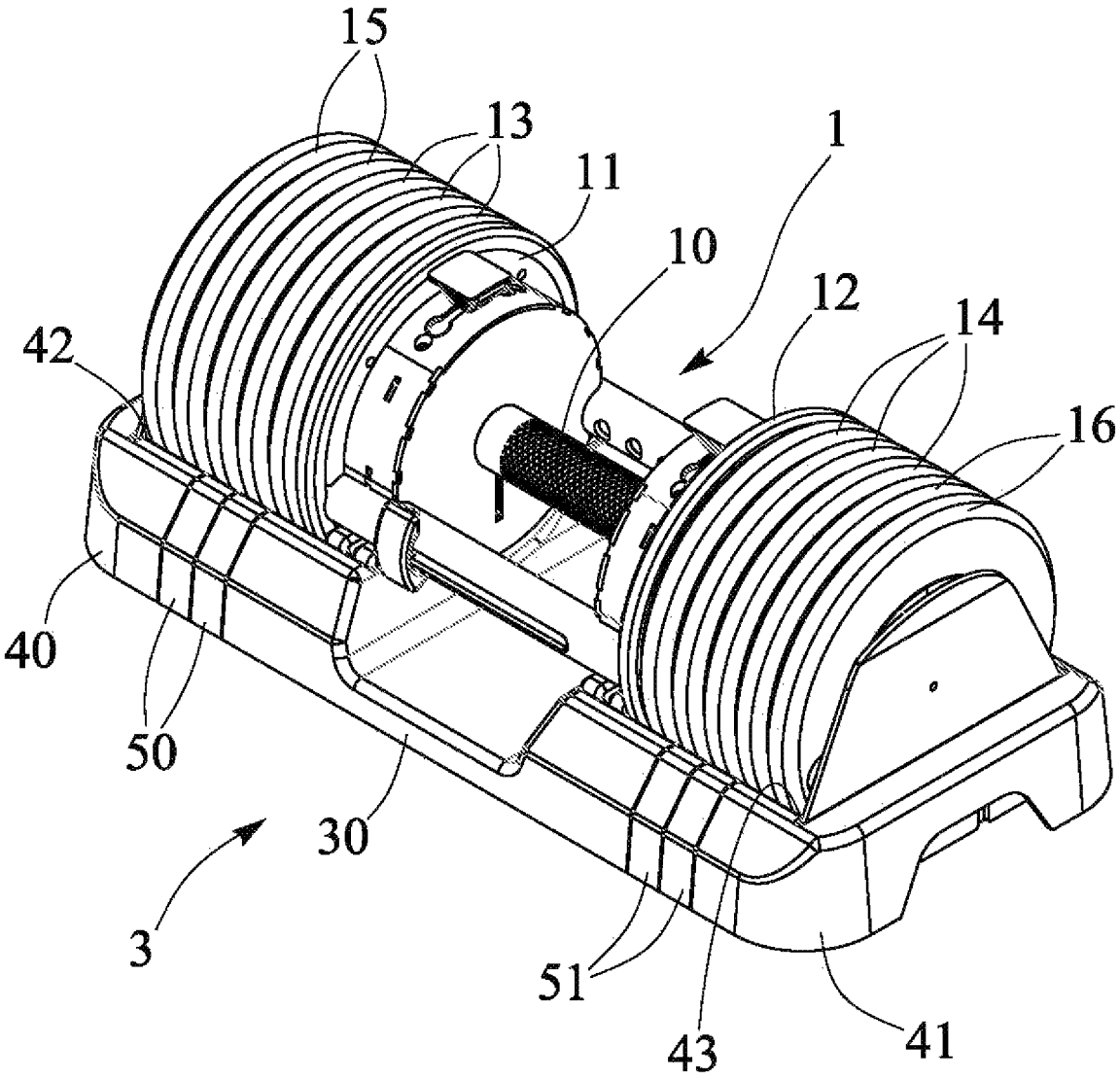
FIG. 1 is a perspective view of an adjustable exercise device in accordance with the present invention.
Figure 2:
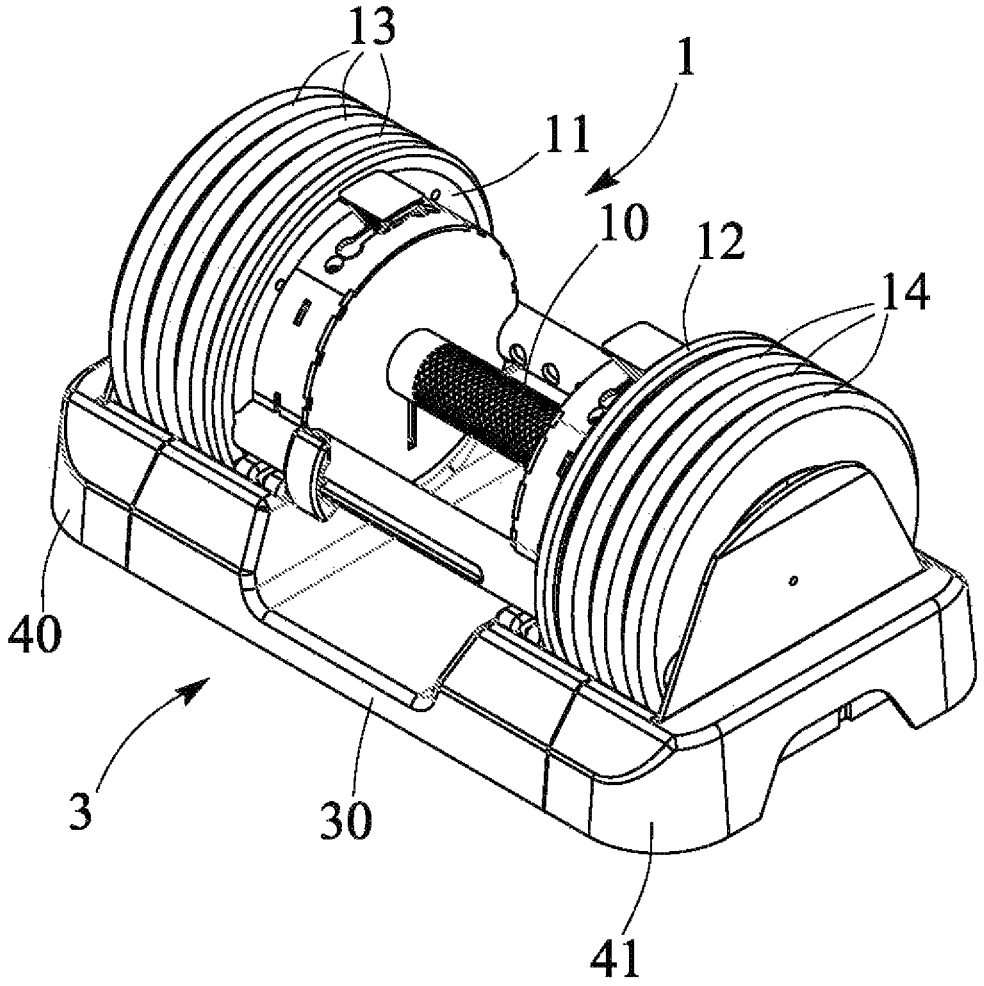
FIG. 2 is another perspective view similar to FIG. 1, illustrating the operation of the adjustable exercise device.
Figure 3:
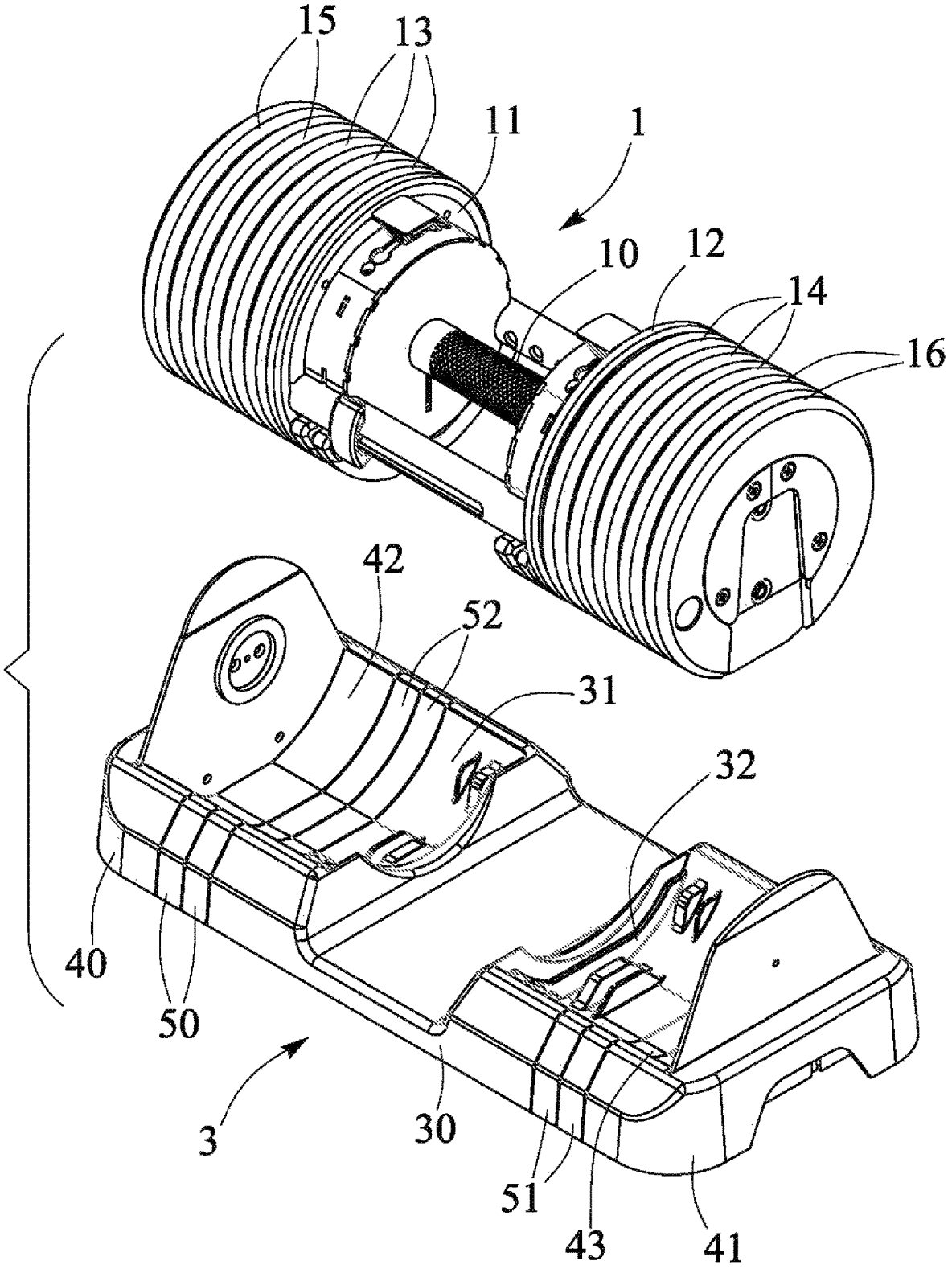
FIG. 3 is a partial exploded view of the adjustable exercise device as shown in FIG. 1.
Figure 4:
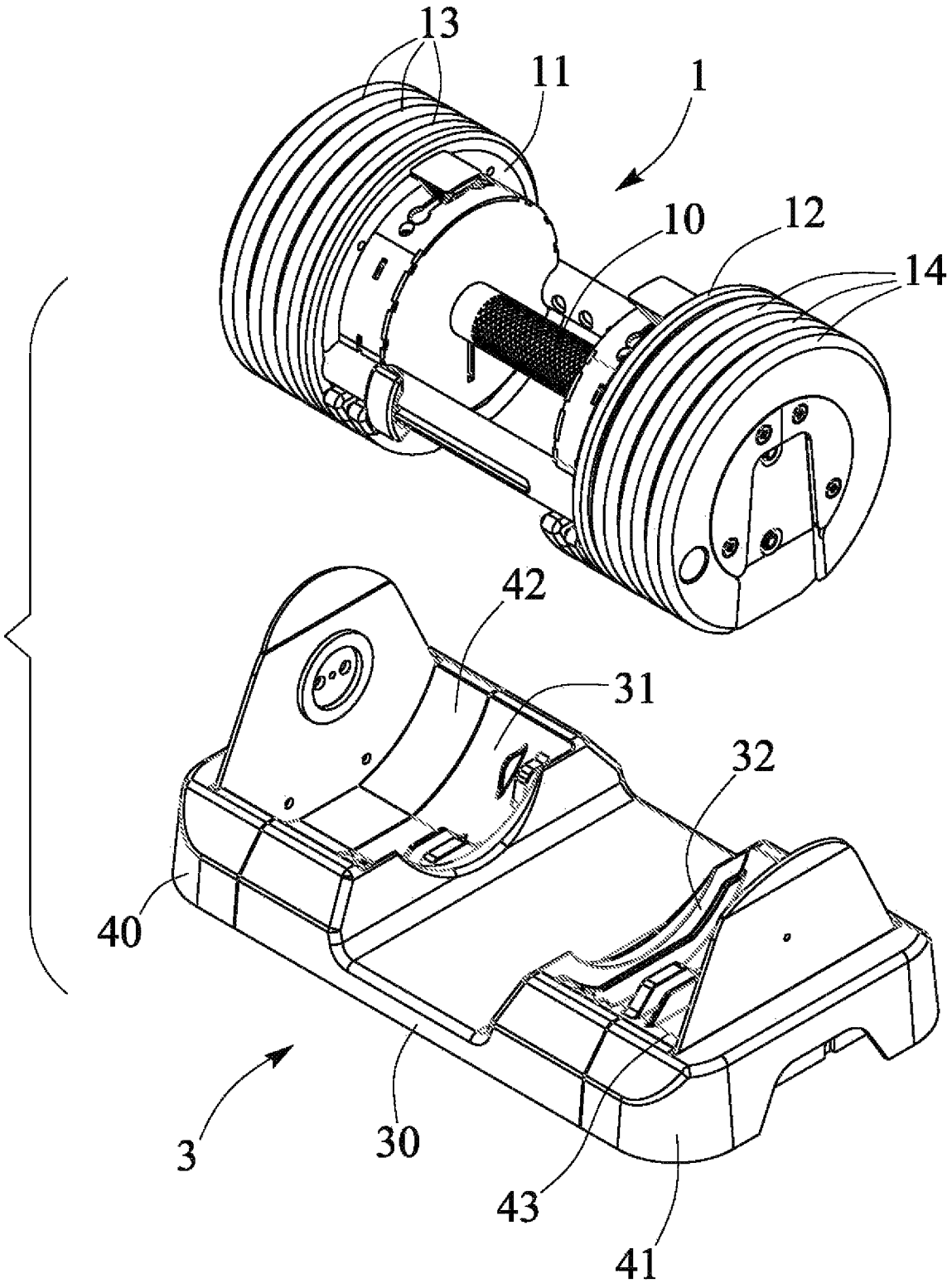
FIG. 4 is another partial exploded view of the adjustable exercise device as shown in FIG. 2.

Referring to the drawings, and initially to FIGS. 1-4, an adjustable exercise device, such as an adjustable barbell, kettle bell, or dumbbell combination in accordance with the present invention comprises a barbell or dumbbell 1 including a central handle bar or member 10 disposed and arranged or located between two spacers or partitions or plates 11, 12, and two groups of weights or weight plates or members 13, 14 detachably or changeably or adjustably attached or mounted or secured to the outer portion of the plates 11, 12 respectively, best shown in FIGS. 2 and 4, for forming or defining a typical adjustable dumbbell which have been disclosed and shown in the cited prior arts.

The adjustable dumbbell may further include one or more weight panels or elements 15, 16 detachably or changeably or adjustably attached or mounted or secured to the outer portion of the weight members 13, 14 respectively, best shown in FIGS. 1 and 3 for allowing the size or standard or length of the adjustable dumbbell to be increased than that of the typical adjustable dumbbell (FIGS. 2, 4). The supporting base of the typical adjustable exercise device or dumbbell normally includes a solid and stable structure or configuration that may not be adjusted relatively and that may no longer be useful for receiving or engaging with the weight members 13, 14 and the weight elements 15, 16.

The adjustable exercise device further includes a supporting base or receptacle 3 including an adjustable structure or configuration for suitably and selectively receiving or engaging with the weight members 13, 14 (FIG. 2) and/or the weight elements 15, 16. The receptacle 3 includes a central member or housing 30 for receiving or engaging with or supporting the handle member 10, and the housing 30 includes one or more (such as two) recesses or compartments or depressions 31, 32 formed therein, such as formed in the two side portions thereof for receiving or engaging with the plates 11, 12 of the handle member 10 or of the adjustable exercise device or dumbbell respectively.

The receptacle 3 further includes one or more (such as two) end members or casings 40, 41 to be detachably attached or mounted or secured to the outer portion of the housing 30 respectively, best shown in FIGS. 2 and 4, for forming or defining the supporting base of the typical adjustable dumbbell which includes a relatively smaller or shorter size or standard or length for suitably receiving or engaging with the weight members 13, 14 (FIG. 2). The casings 40, 41 each include a cavity or notch or recess 42, 43 formed therein for receiving or engaging with the outer weight members 13, 14 (FIGS. 2 and 4) or the outer weight elements 15, 16 (FIGS. 1 and 3).

The housing 30 further includes one or more (such as two) anchoring members 33, such as dovetail slots 33 formed therein, such as formed in each of the two outer side portions thereof (FIGS. 5-6), i.e. opened and faced or directed outwardly or away from the housing 30, and the casings 40, 41 each include one or more (such as two) projections or anchoring elements or dovetails 44 formed or provided in the inner side portion thereof, i.e. faced or directed toward the housing 30 for selectively engaging with the anchoring members or dovetail slots 33 of the housing 30 and for detachably attaching or mounting or securing the casings 40, 41 to the housing 30 (FIGS. 2 and 4).

The receptacle 3 further includes one or more (such as two) partitions or frames or spacers 50, 51 detachably or changeably or adjustably attached or mounted or secured to either of the outer portions of the housing 30, and/or disposed or engaged between the housing 30 and the casings 40, 41 respectively, for allowing the distance between the housing 30 and the casings 40, 41 to be suitably increased and thus for allowing the weight members 13, 14 and the weight elements 15, 16 to be suitably received or engaged or supported in the receptacle 3 (FIGS. 1 and 3). The spacers 50, 51 each include a recess or depression or space 52, 53 formed therein for suitably receiving or engaging with the weight members 13, 14 and/or the weight elements 15, 16.

The spacers 50, 51 each further include one or more (such as two) anchoring members 54, such as dovetail slots 54 formed therein, such as formed in the outer side portion thereof (FIGS. 5-6), i.e. opened and faced or directed outwardly or away from the housing 30 for detachably or changeably or adjustably receiving or engaging with the anchoring elements or dovetails 44 of the casings 40, 41 and for detachably or changeably or adjustably attaching or mounting or securing the spacers 50, 51 to the casings 40, 41; and each further include one or more (such as two) projections or anchoring elements or dovetails 55 formed or provided in the inner side portion thereof, i.e. faced or directed toward the housing 30 for selectively engaging with the anchoring members or dovetail slots 33 of the housing 30 and for detachably attaching or mounting or securing the spacers 50, 51 to the housing 30.

Figure 5:
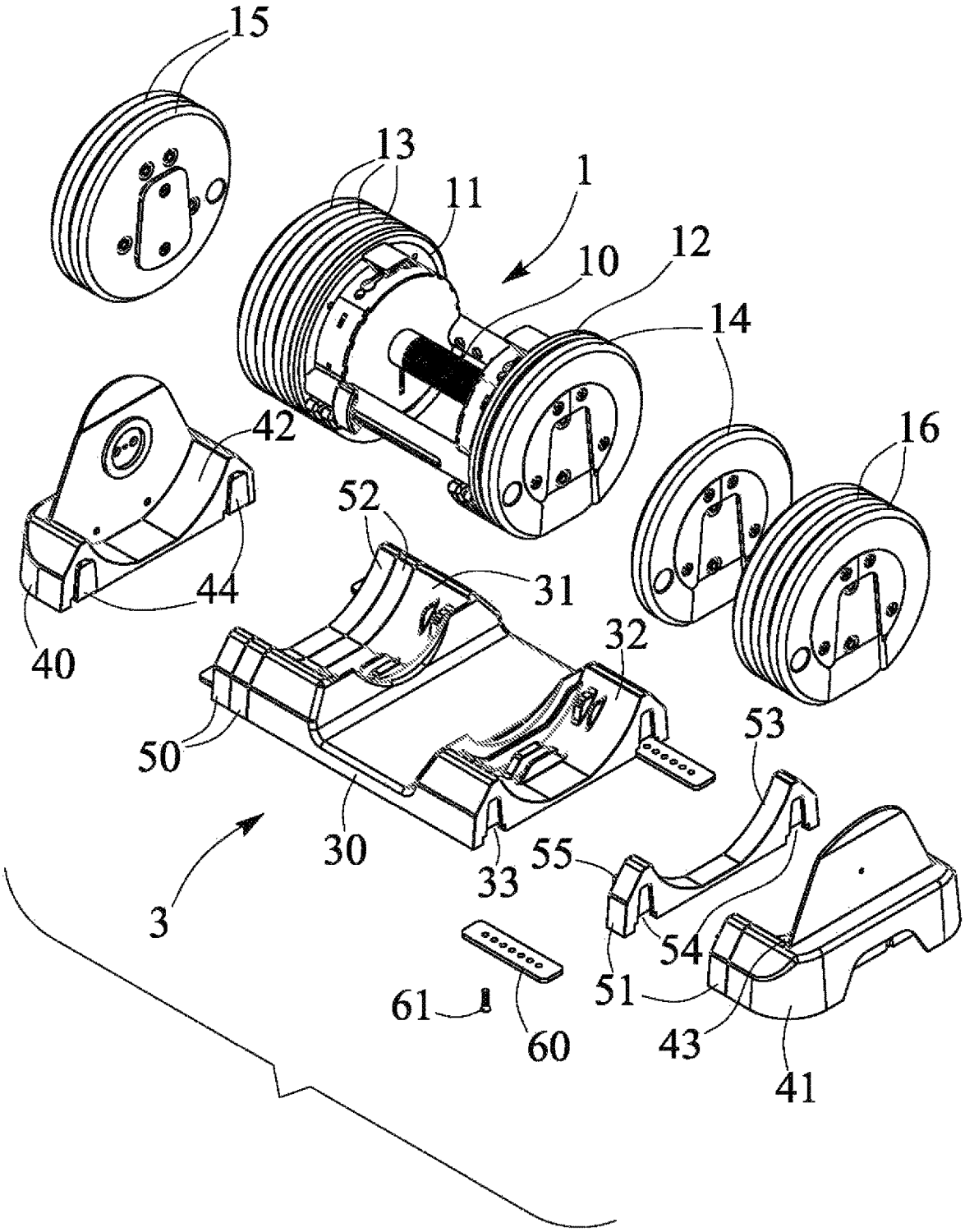
FIG. 5 is a further partial exploded view of the adjustable exercise device as seen from the upper portion of the exercise device.
Figure 6:
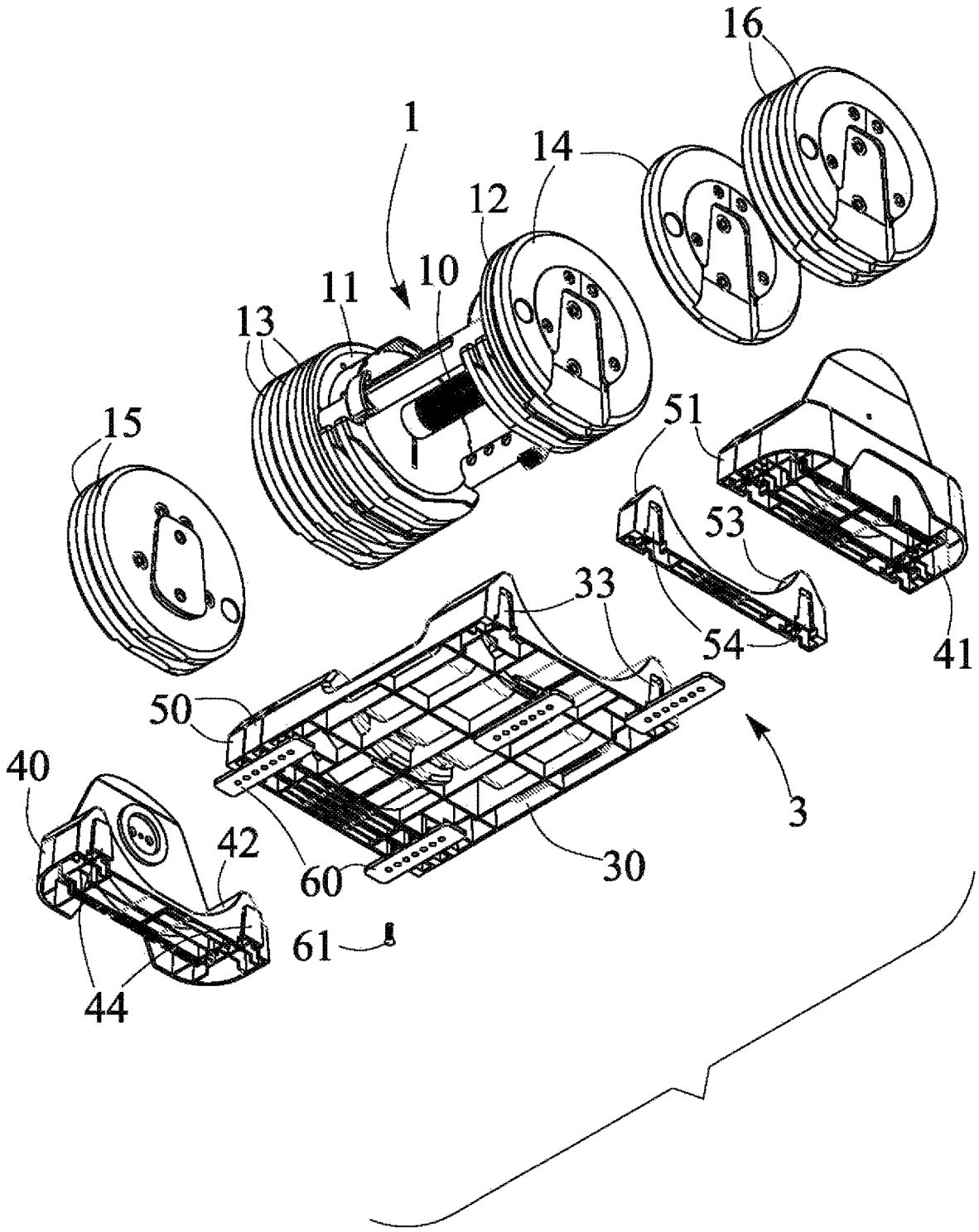
FIG. 6 is a still further partial exploded view of the adjustable exercise device as seen from the bottom portion of the adjustable exercise device.

As also best shown in FIGS. 5 and 6, the receptacle 3 may further include one or more strips or stripes or bands or anchors 60 attached or mounted or secured to or engaged with the housing 30 and/or the spacers 50, 51 and/or the casings 40, 41 for detachably or changeably or adjustably attaching or mounting or securing the housing 30 and/or the spacers 50, 51 and/or the casings 40, 41 to each other, and/or one or more screws or bolts or latches or fasteners 61 or the like engaged with the anchors 60 for solidly and stably anchoring or retaining or securing the housing 30 and/or the spacers 50, 51 and/or the casings 40, 41 to each other.

In operation, as shown in FIGS. 2 and 4, when only the weight members 13, 14 are attached or mounted or secured to the plates 11, 12 or directly to the handle member 10, and when no weight elements 15, 16 are attached or mounted or secured to the weight members 13, 14, the casings 40, 41 are directly attached or mounted or secured to the housing 30 without the spacers 50, 51 for suitably receiving or engaging with the weight members 13, 14. As shown in FIGS. 1 and 3, when the weight elements 15, 16 are attached or mounted or secured to the weight members 13, 14, one or more spacers 50, 51 may further be provided and attached or mounted or secured to the housing 30, and/or engaged between the housing 30 and the casings 40, 41 for allowing the weight members 13, 14 and the weight elements 15, 16 to be suitably received or engaged or supported in the receptacle 3.

Accordingly, the adjustable exercise device in accordance with the present invention includes a solid and stable structure or configuration for solidly and stably coupling the weight members of the dumbbell together and for preventing the weight members of the adjustable dumbbell from being disengaged or separated from each other, and having an adjustable supporting base for allowing the supporting base to be suitably adjusted to different sizes or lengths or standards for receiving or engaging with the numbers of the weight members of the exercise device or the adjustable dumbbell.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable exercise device comprising:

a dumbbell including a handle member, a first weight member and a second weight member attached to said handle member, and a first weight element and a second weight element attachable to said first and said second weight members respectively, and a receptacle including:

a housing, said housing including an anchoring member formed in each of two outer side portions, a first casing and a second casing engageable to said housing for receiving and engaging with said first and said second weight members respectively, said first and said second casings each including an anchoring element for engaging with said anchoring members of said housing and for detachably attaching said first and said second casings to said housing, and at least one first spacer and at least one second spacer detachably attached to said housing and engaged between said housing and said first and said second casings respectively for receiving and engaging with said first and said second weight elements, said at least one first spacer and said at least one second spacer each including a second anchoring member for engaging with said anchoring element of said first and said second casings, and a second anchoring element for engaging with said anchoring members of said housing and for detachably attaching said first and said second casings and said at least one first spacer and said at least one second spacer and said housing together.

2. The adjustable exercise device as claimed in claim 1, wherein said dumbbell includes two plates attached to said handle member, and said first and said second weight members are attachable to said plates respectively, and said housing includes two depressions formed in said housing for receiving and engaging with said plates respectively.

3. The adjustable exercise device as claimed in claim 1, wherein said first and said second casings each include a recess for receiving and engaging with either of said first and said second weight members or of said first and said second weight elements.

4. The adjustable exercise device as claimed in claim 1, wherein said at least one first spacer and said at least one second spacer each include a space for receiving and engaging with either of said first and said second weight members or of said first and said second weight elements.

5. The adjustable exercise device as claimed in claim 1, further comprising at least one anchor for detachably securing said first and said second casings and said at least one first spacer and said at least one second spacer and said housing together.

6. The adjustable exercise device as claimed in claim 1, further comprising at least one fastener for detachably securing said first and said second casings and said at least one first spacer and said at least one second spacer and said housing together.

* * * * *